United States Patent [19]

Björk et al.

[11] 4,221,166

[45] Sep. 9, 1980

[54] DEVICE FOR ANCHORING A BUOYANT MINE AT A PRESET DEPTH

[75] Inventors: Jan Björk, Bjärred; Jan T. Olsson, Landskrona; Bengt M. Holmberg, Bjärred, all of Sweden

[73] Assignee: SAB Industri AB, Malmo, Sweden

[21] Appl. No.: 949,020

[22] Filed: Oct. 6, 1978

[30] Foreign Application Priority Data

Oct. 7, 1977 [SE] Sweden ..... 7711274

[51] Int. Cl.[2] ..... F42B 22/10

[52] U.S. Cl. ..... 102/13

[58] Field of Search ..... 102/13, 14

[56] References Cited

U.S. PATENT DOCUMENTS

| | | | |
|---|---|---|---|
| 1,151,902 | 8/1915 | Rey | 102/13 |
| 3,016,828 | 1/1962 | Bowersett | 102/13 |
| 3,789,758 | 2/1974 | Plice | 102/13 |

*Primary Examiner*—Charles T. Jordan

*Attorney, Agent, or Firm*—Laurence R. Brown

[57] ABSTRACT

A mine anchor for anchoring a buoyant mine and provided with a rotatable drum for a mine anchoring wire.

In order to obtain a reliable and accurate anchoring at a preset depth there is a contact manometer at the mine and a signal line for transmitting a signal therefrom to an exploding device on the mine locking the drum against further rotation.

3 Claims, 2 Drawing Figures

DEVICE FOR ANCHORING A BUOYANT MINE AT A PRESET DEPTH

This invention relates to a device for anchoring a buoyant mine at a preset depth under a water surface by means of a mine anchor provided with a rotatable wire drum for a mine anchoring wire, the mine and the mine anchor being arranged to sink together but to disconnect after having reached the bottom.

Many such devices are known. One type works with a float ascending over the mine at a distance corresponding to the desired mine depth, until it reaches the water surface and the mine ascent is mechanically stopped. Thereafter the float is to be water filled in order to disappear from the water surface. The main disadvantage with this type is that it is complicated and therefore expensive and less reliable.

At a second type the mine anchor is provided with a hydrostat, which can be defined as a manometer and can detect the water depth by the water pressure. The hydrostat will feel the water pressure, when the mine anchor with the mine has sunk to the bottom, and the mine anchor will let out a length of wire corresponding to the difference between the bottom depth and the preset mine depth. The main disadvantage with this type is that it is difficult to obtain the desired accuracy with a hydrostat, especially if the bottom depth is more than 100 m.

The problem is thus to accomplish a device of the kind defined which is simple and not too expensive but still reliable and able to anchor the mine at the preset depth with the desired accuracy, especially if the bottom depth is more than say 100 m.

This is according to the invention attained in that the device is characterized by a contact manometer at the mine for giving an electric signal at the reaching of the preset depth, a signal line for transmitting the signal from the contact manometer to a battery housing on the mine anchor, containing batteries, and an electrically ignitable exploding device positively locking the wire drum against further rotation at the occurrence of said signal due to the closing of a circuit including said batteries and said exploding device.

In a practical embodiment the exploding device comprises an electrically ignitable exploding screw connected to a plunger, arranged in a housing in the vicinity of a wire drum flange, provided with circumferential recesses, in such a position as to engage one of said recesses after the ignition of said screw.

Figure 1:
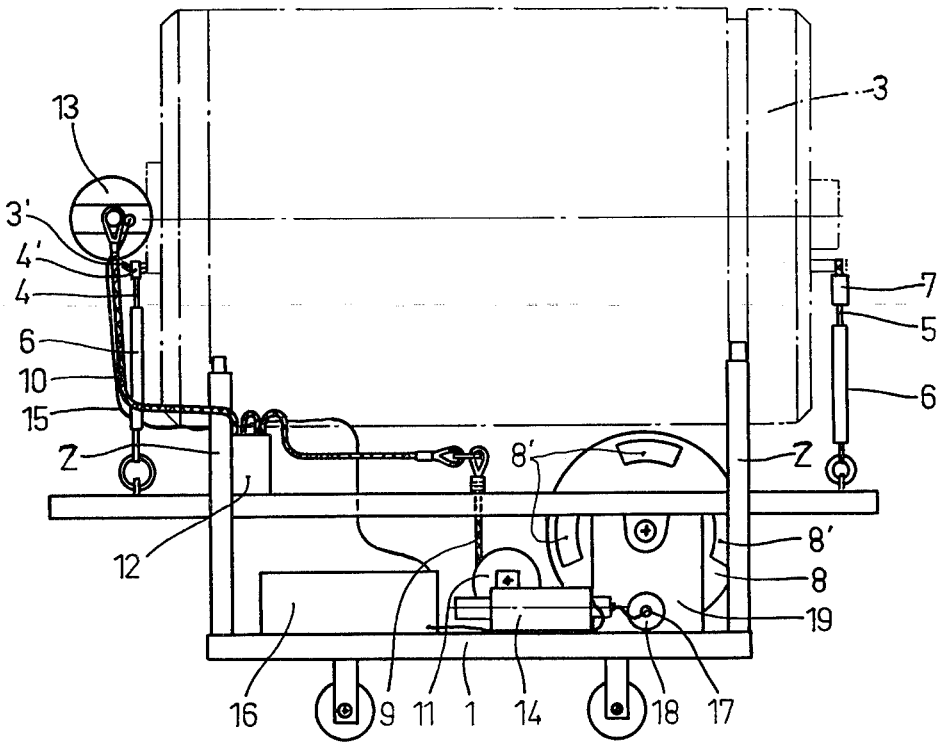
Figure 2:
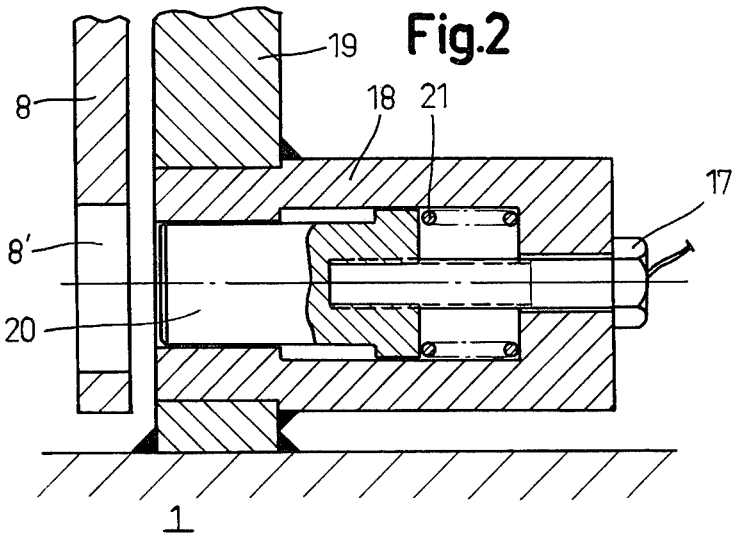

The invention will be described in further detail below, reference housing made to the accompanying drawing, in which:

FIG. 1 is a side view of a mine anchor according to the invention provided with a faintly outlined mine, and FIG. 2 is a sectional view to a larger scale of a detail in said mine anchor.

A wheeled mine anchor 1 is provided with fixed mine supports 2. A buoyant mine 3 is placed on these supports and is held to the mine anchor by means of two rods 4, 5 each provided with a streching screw 6. The left rod 4 as viewed in FIG. 1 is attached to the mine 3 by means of a ring 4' laid over a hook 3' on the mine. The right rod 5 is provided with a device 7 disconnecting the mine 3 from the mine anchor 1 after a certain time under the influence of water.

The mine anchor 1 is provided with a rotatable drum 8 with a supply of mine anchoring wire 9 and has greater sinking capacity than the buoyancy of the mine. The wire 9, preferably of steel, may as shown be connected to the mine via a shorter length (say 2.5 m) of a cable 10 of a non-magnetic material, such as polyester, if the mine is provided with a magnetic sensor device.

A wire pulley 11 rotatably attached to the mine anchor 1 is arranged to guide the wire 9 from the drum 8. There is a box 12 for storing the cable 10.

A contact manometer 13 is arranged at the end of the mine 3, where the cable 10 is attached, or may as an alternative be placed inside the mine 3 at the same end. The contact manometer 13 is arranged in a receptacle, which is to be hermetically closed just before the launching of the mine anchor 1 with its mine 3, so that the atmospheric pressure will be the reference pressure for the manometer. When the surrounding water pressure at the mine ascent has reached a set value or in other words when a preset depth has been reached an electric contact controlled by the manometer will be closed. In a practical embodiment the anchoring depth may be continuouly set from 10 to 70 m, and the anchoring accuracy obtained is $\pm 1$ m. Further, the water depth may be 200 m or even more.

The manometer 13 is connected to a battery housing 14 on the mine anchor 1 by means of a conductive insulated signal line 15, and a supply 16 therefore is arranged on the mine anchor 1. This battery housing 14 contains batteries as well as relay means for closing a circuit from the batteries to an exploding screw 17, which will be described further below but whose function is to prevent further rotation of the wire drum 8 at the occurrence of a signal from the contact manometer 13.

As appears from FIG. 2 the exploding screw 17 is arranged in a housing 18 attached to a console 19 on the mine anchor 1. The screw 17, which may be made of a plastics material, is attached to a plunger 20 axially movably arranged in the housing 18. The screw 17 contains an electrically ignitable small explosive charge capable of severing its head from the remainder thereof. When that happens the plunger 20 will be free to move into engagement with one of several recesses 8' in the flange of the wire drum 8 under the action of partly the charge in the screw 17, partly a compression spring 21 arranged between the housing 18 and the plunger 20.

The function of the mine anchor together with the mine is as follows:

After launching from a ship the combination consisting of the mine anchor 1 and the mine 3 will sink to the bottom with a speed of for example 2 m/s. After a certain time (well over the maximum sinking time and in a practical case 5–10 min.) the disconnecting device 7 will sever the rod 5 under the influence of the water, so that the mine 3 will be free from the mine anchor 1 and can start to ascend due to its buoyancy. At the same time the contact manometer 13 will automatically be connected to the signal line 15 by means of a mercury switch reacting on the changed position of the mine with the manometer 13.

The batteries in the battery housing 14 will be connected to the circuitry during the descending due to their placement in a part of the battery housing movable under the action of the rising water pressure.

When the mine 3 during its ascending has reached the predetermined depth a signal will reach the battery housing 14 from the contact manometer 13 through the signal line 15. The relay means therein will contact the batteries to the exploding screw 17, which will set the plunger 20 free to stop the wire drum 8 and thus the ascending of the mine 3 by engaging one of the recesses 8′ of the drum 8. If there are four such recesses 8′ as shown, the drum 8 will only be allowed to rotate less than ¼ turn after the explosion of the screw 17.

Modifications are possible within the scope of the appended claims. Especially the design of the electrically ignitable exploding device may be changed.

We claim:

1. A device for anchoring a buoyant mine at a predetermined depth under a surface of a body of water comprising in combination, a mine anchor provided with a rotatable wire drum, a mine anchoring wire reelably wound within the drum for anchoring said mine, said wire being connected to said mine and adapted for being played out upon rotation of said drum, the mine and mine anchor being sinkable together but adapted to disconnect after reaching the bottom of said body of water with said mine being buoyantly ascendable in said body of water, a contact manometer connected to the mine for giving an electrical signal when the predetermined depth is reached, a signal line connected between the mine and the mine anchor for transmitting the signal from the manometer to the mine anchor, and an electrically activated exploding device disposed on the mine anchor and actuatable at the occurrence of said signal for positively locking the wire drum against further rotation.

2. The device of claim 1 wherein said wire drum is provided with a plurality of apertures, and said exploding device comprises an electrically ignitable exploding bolt connected to a plunger, said plunger being receivable within one of said apertures after ignition of said bolt.

3. The device of claim 2 wherein said drum is provided with a flange, said apertures are disposed within the flange, said exploding device is disposed within a housing secured to the mine anchor in the vicinity of the flange, and said bolt is supported within the housing.

* * * * *